United States Patent [19]

Nielsen

[11] 4,315,538

[45] Feb. 16, 1982

[54] METHOD AND APPARATUS TO EFFECT A FINE GRAIN SIZE IN CONTINUOUS CAST METALS

[76] Inventor: Thomas D. Nielsen, 148 Overbrook Rd., Elyria, Ohio 44035

[21] Appl. No.: 135,330

[22] Filed: Mar. 31, 1980

[51] Int. Cl.[3] ..... B22D 11/00

[52] U.S. Cl. ..... 164/488; 164/439

[58] Field of Search ..... 164/82, 85, 89, 421, 164/84, 443, 418, 52, 252, 439

[56] References Cited

U.S. PATENT DOCUMENTS

| | | | |
|---|---|---|---|
| 4,000,773 | 1/1977 | Sevastakis | 164/85 |
| 4,137,961 | 2/1979 | Mola | 164/49 |
| 4,154,291 | 5/1979 | Nielsen | 164/421 |

FOREIGN PATENT DOCUMENTS

| | | | |
|---|---|---|---|
| 2749405 | 5/1979 | Fed. Rep. of Germany | 164/84 |
| 748709 | 5/1956 | United Kingdom | 164/82 |
| 750131 | 6/1956 | United Kingdom | 164/443 |
| 435052 | 11/1974 | U.S.S.R. | 164/443 |
| 546429 | 3/1977 | U.S.S.R. | 164/82 |

*Primary Examiner*—Robert D. Baldwin
*Assistant Examiner*—K. Y. Lin
*Attorney, Agent, or Firm*—Fay & Sharpe

[57] ABSTRACT

Method and apparatus used for continuous casting of copper alloy rods for obtaining a fine grain size therein. Liquidus copper alloy material flows from a reservoir area or crucible into a continuous casting die. Devices are included to cause agitation of the liquidus material as it enters the die so that no thermal gradients are large enough at the liquidus-solid state transition zone to produce gross directional solidification of the alloy. Devices which may be used to obtain the desired liquidus material agitation include a particular configuration and location for the die inlet openings, electromagnetic stirring and mechanical stirring.

7 Claims, 6 Drawing Figures

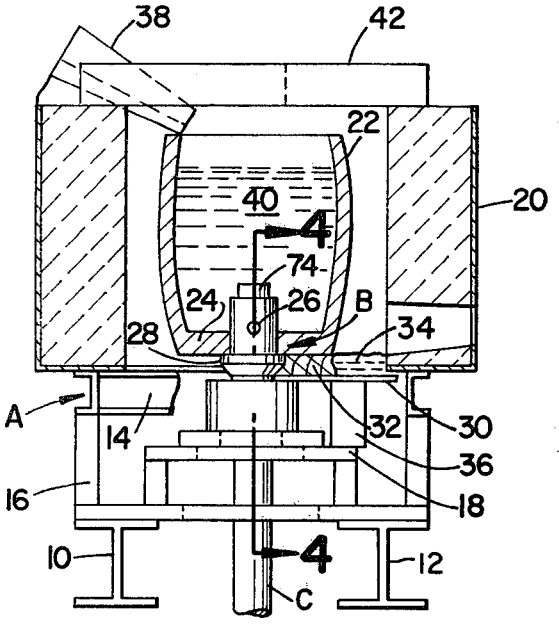
FIG. 1
FIG. 2
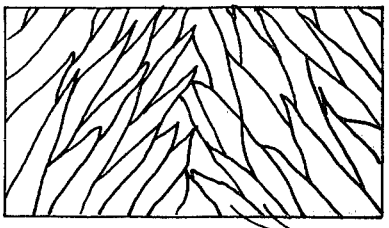
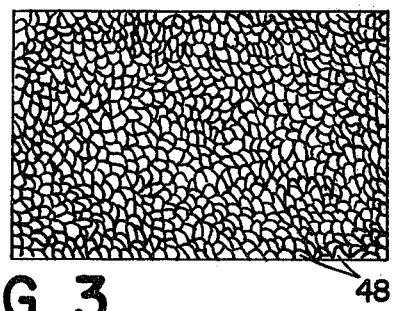
FIG. 3
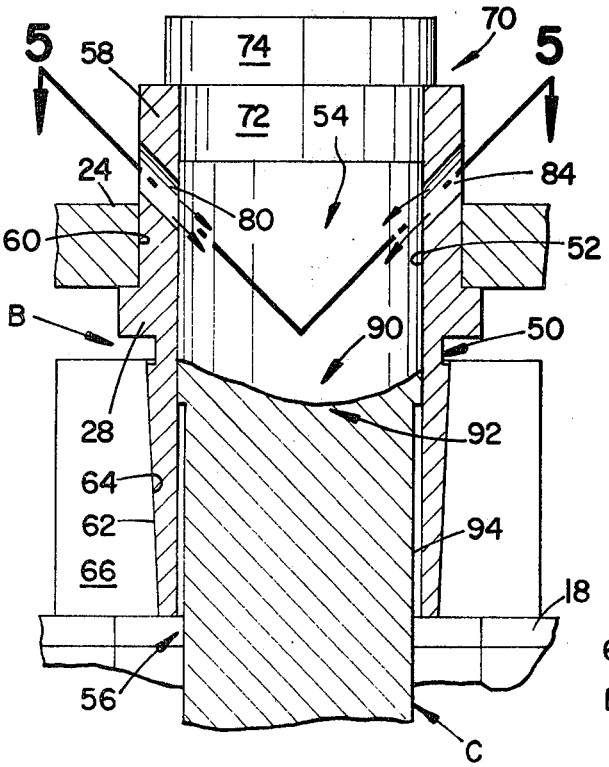
FIG. 4
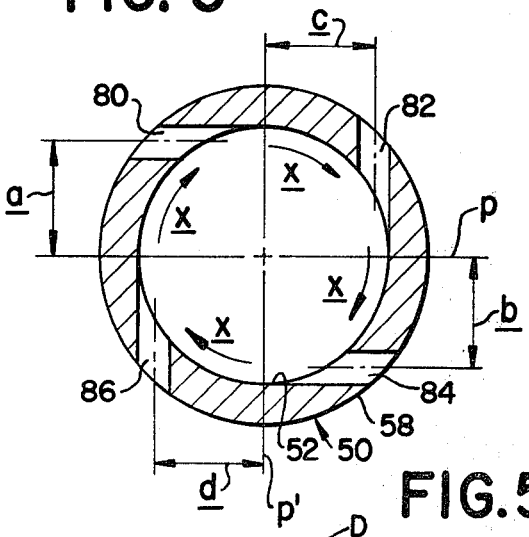
FIG. 5
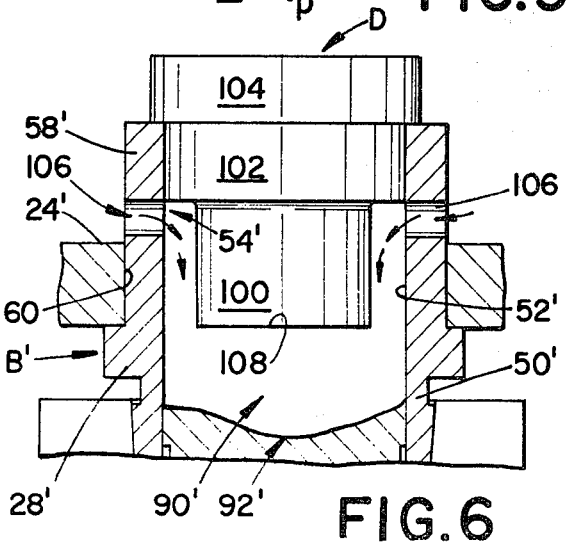
FIG. 6

METHOD AND APPARATUS TO EFFECT A FINE GRAIN SIZE IN CONTINUOUS CAST METALS

BACKGROUND OF INVENTION

This invention pertains to the art of continuous casting and more particularly to continuous casting of solid rods, although it is also applicable to the casting of tubing and other shapes.

The invention is particularly applicable to method and apparatus for effecting a fine grain structure in continuous cast copper alloy rods and will be described with particular reference thereto. However, it will be appreciated by those skilled in the art that the invention has broader applications and could be adapted to use for other alloys or materials in other environments.

In continuous casting of solid rods, one type of general casting system employed utilizes a stationary die wherein the casting is intermittently moved generally longitudinally in order to effect the required casting conditions. During a so-called withdrawal stroke, the casting moves fast enough so that only liquid metal enters the cooled length of the die for causing intimate die-metal contact. This stroke is followed by a dwell period during which the casting is stopped or slowed down so that it will exit from the solidification zone at the proper temperature.

Heretofore, in continuous casting of copper and copper alloy rods using the above described as well as other techniques, gross directional solidification occurred in the rod during alloy transition from the liquid to the solid state. Such gross directional solidification results in the development of crystals or grains which grow generally opposite to the direction of heat flow. The grains are usually quite long in the direction of casting and coarse to fine at right angles to that direction. As a result, cold drawing or working of continuous cast copper alloy rods has previously been very difficult or impossible due to the thick grain boundaries generally associated with these structures. Attempts at such cold drawing have undesirably caused cracks and imperfections to appear in the rods as a result of the coarse grains. This, in turn, generates scrap and/or unacceptable end products.

Moreover, if the liquid metal is too hot and/or the casting speed too slow, the grain structure takes on a coarse elongated configuration generally in the direction of casting. Such grain structure is wholly undesirable for metals which are to be subsequently cold drawn. Thus, and within normal casting practice, it is possible to vary the casting parameters so as to alter the grain structure of the cast rod. However, it is not possible to alter these parameters by an amount or to the degree necessary to effect a grain structure which is readily conducive to cold working.

It is known to be beneficial to all casting and metal working schemes to have the grain boundaries be as thin as possible. For this reason, it has been considered desirable to develop an arrangement which would readily facilitate obtaining such fine grain structures in continuous cast copper alloy rods. This result would then satisfactorily accommodate subsequent cold drawing or working of the cast rods. The subject invention is believed to fully meet these desires and provide a substantial, worthwhile improvement by way of both method and apparatus.

BRIEF DESCRIPTION OF THE INVENTION

In the present invention, a method is provided for obtaining a fine grain structure in a continuous cast alloy rod. In such a continuous casting operation, liquidus alloy material flows from a reservoir into a hollow die for transformation into the solid state or phase having the configuration of the die cavity. The rod itself is continuous in nature and exits from a die output end. Broadly, the method comprises the steps of delivering molten metal to the hollow die in a manner which prevents the presence or development of thermal gradients which are large enough to produce gross directional solidification at the interface or alloy transition zone from a liquid to a solid state. Generally, the method contemplates use of any step which renders the so-called near freezing area of the die thermally uniform.

In accordace with the preferred method, liquid alloy is delivered into the die in a manner causing a cyclonic action therein. Such action facilitates even heat distribution and advantageously provides for the development of a desirable type of crystalline or grain structure.

One specific alternative method for obtaining the desired results resides in stirring the liquid alloy in the die at the near-freezing area. Such stirring may be effected by, for example, electromagnetic or mechanical means. Another alternative resides in placing a heat distributing insert in the die adjacent the area of flow communication between the reservoir and die and in a heat transfer relationship with liquid alloy material flowing into the die.

In accordance with a further aspect of the invention, an improvement is provided for casting apparatus used in continuous casting alloy material into solid rods wherein liquidus alloy flows from a reservoir into a hollow die for transformation into a solid state at a transition zone or area. Such transition forms successive portions of a continuous rod having the same cross-sectional configuration as the die cavity. The rod thus formed is continuously drawn outwardly from a die exit end. The improved arrangement facilitates obtaining a continuous cast copper alloy rod having a fine grain structure. The improvement itself comprises means associated with the die for causing uniform temperatures in the liquid alloy throughout the near freezing area of the die. These means prevent the presence or development of any thermal gradients which are large enough to produce gross directional solidification of the alloy. The means for causing also effects an even distribution of solid particles which have been sheared off parent crystals. These particles act as nuclei.

In accordance with the preferred arrangement of the invention, the means for causing comprises a plurality of feed openings or holes located in the die and positioned relative thereto and to each other so as to automatically produce a cyclonic motion in the liquid alloy as it flows into the die.

Pursuant to a more limited aspect of the invention, the total cross-section of all the plurality of feed openings is approximately 1/40 of the cross-sectional area of the resulting casting.

According to a still further aspect of the invention, the means for causing may advantageously comprise means to effect stirring of the liquid alloy adjacent the near freezing zone in the die. Also, a heat conductive distributor insert may be positioned in the top area of the die to achieve generally uniform alloy temperartures at the near freezing zone or area.

The principal object of the present invention is the provision of a new and improved method and apparatus to effect fine grain structure in continuous cast alloy rods.

Another object of the invention is the provision of such method and apparatus which are relatively simple and easy to implement into practical application.

A still further object of the present invention is the provision of method and apparatus which allow continuous cast alloy rods to be cold drawn or subsequently processed without encountering adverse rod cracking or the like.

Still other objects and advantages for the invention will become readily apparent to those skilled in the art upon a reading and understanding of the following specification.

BRIEF DESCRIPTION OF THE DRAWINGS

The invention may take physical form in certain parts and arrangements of parts, preferred and alternative embodiments of which will be described in detail in this specification and illustrated in the accompanying drawings which form a part hereof and wherein:

FIG. 1 is a somewhat schematic view in partial cross-section of a typical facility used in continuous casting of metallic rod members for ease of appreciating the general environment to which the invention is particularly directed;

FIG. 2 is a generally schematic view of the coarse grain structure obtained in a continuous cast copper alloy rod using prior manufacturing techniques;

FIG. 3 is a generally schematic cross-sectional view of the fine grain structure obtained in continuous cast copper alloy rods when using the subject invention;

FIG. 4 is a partial cross-sectional view taken along lines 4—4 of FIG. 1 for showing the die and die feed openings utilized in practicing the subject invention;

FIG. 5 is a cross-sectional view taken generally along lines 5—5 of FIG. 4 for showing the positioning of the feed openings relative to each other around the die; and, FIG. 6 is a partial cross-sectional view similar to FIG. 4 of an alternative arrangement which utilizes a heat conductive distributor insert.

DESCRIPTION OF THE PREFERRED EMBODIMENT

Referring now to the drawings wherein the showings are for purposes of illustrating the preferred and an alternative embodiment of the invention only and not for purposes of limiting same, FIG. 1 shows a continuous vertical casting facility A including a die and cooler assembly B for the continuous casting of a solid rod member or strand C. While many different metals, including brass, aluminum, bronze and the like, are cast by using such apparatus, the subject invention as described herein focuses on the continuous casting of copper alloy materials into solid rods or strands.

More particularly, continuous casting facility A may comprise any number of types or styles of such facilities which could advantageously incorporate the concepts of the subject invention thereinto. One such facility is generally schematically shown in FIG. 1 and includes a pair of spaced apart beam-like bases 10,12 supporting upper frame members generally designated 14,16. A platform type arrangement generally designated 18 is supported by members 10,12 which, itself, supports a portion of die and cooler assembly B. Platform type arrangement 18 includes suitable openings therethrough in line with the die and cooler assembly to permit passage of strand C therethrough. An open ended cylindrical holding furnace sleeve 20 is supported by frame members 14,16 and receives a generally cup-shaped crucible 22 therein. Crucible 22 acts as a liquidus alloy reservoir and includes a bottom wall 24 having a portion of die and cooler assembly B extending therethrough. In this manner, a plurality of peripherally spaced apart metal intake openings 26 are placed in fluid communication with the inside of the crucible. A radially outward extending flange 28 on the die and cooler assembly engages the underside of bottom wall 24 to provide a convenient locating relationship between these components.

A bottom plate generally designated 30 is supported by a portion of the die and cooler assembly closely adjacent the bottom of holding furnace sleeve 20. This bottom plate, in turn, provides a base for a cementitious material generally designated 32 disposed about the lowermost end of the crucible and around a portion of the die and cooler assembly. Plate 30 further provides a base for fire clay material 34 interposed between cementitious material 32 and inner wall of sleeve 20. Fire clay brick generally designated 36 is conveniently interposed between platform 18 and the lower surface of bottom plate 30. A pouring spout generally designated 38 facilitates pouring of molten copper alloy metal 40 from outside the holding furnace to crucible 22 and a holding furnace lid 42 is conveniently provided to cover the top of sleeve 20 to thereby substantially enclose the crucible.

During a continuous casting operation, rod member or strand C emerges in a generally vertical disposition from the lower end of die and cooler assembly B. In the type of casting process to which the subject invention is particularly directed, appropriate pinch rolls (not shown) are disposed beneath the die and cooler assembly for withdrawing the strand from the die as it is being cast. These pinch rolls are conventional and include means for coordinating the operation of the remainder of the facility components for achieving the desired physical characteristics for strand C in a manner to be described hereinafter.

Casting facility A as shown in FIG. 1 merely comprises a general or schematic showing of the various components as well as their relative relationships to each other for permitting an appreciation of the particular environment here involved. The specific construction, components and so on may very between individual continuous casting facilities and such variances are not deemed to in any way effect the overall scope or intent of the present invention. Moreover, and in view of the fact that the facility itself does not form a part of the invention and that operation thereof is generally known in the art, a further detailed description thereof is deemed unnecessary to permit those skilled in the art to have a full and complete understanding of the invention.

FIG. 2 schematically shows the type of macrostructure obtained in a copper alloy rod or strand using previous continuous casting techniques. This macrostructure is developed as a result of individual crystals or grains 46 growing oppositely from the direction of heat flow within the die. Grains 46 are typically quite elongated in the general direction of casting and coarse to fine in a direction generally normal to the direction of casting. Because of this type of grain structure and resultant thick grain boundaries, continuous cast copper alloy rods haver heretofore been very difficult or impossible to cold draw or work subsequent to the initial casting process.

While such grain structures can be modified to some degree by varying the temperature of the liquidus copper alloy material at the time of casting and/or the casting speed, it is not possible to vary these parameters a sufficient amount in and of themselves to obtain a grain structure which will overcome the above noted problems. There is just no non-chemical method for satisfactorily refining the grain size of cast copper alloys. Moreover, the chemical additive which has been found to be most effective is iron. However, iron must be used in amounts which are deleterious to casting quality.

FIG. 3 schematically shows a macrostructure comprised of small polygonal grains 48 that exhibit no gross directional solidification such as is shown in FIG. 2. Grains 48 also have thin grain boundaries. The ability to readily attain the grain structure of FIG. 3 would greatly enhance the cold drawing or working capabilities of copper alloy rods or strands following initial casting thereof. The subject invention successfully accommodates formation of this desirable macrostructure to thereby provide a substantial improvement to the art of continuous casting copper alloy rods or strands.

In that regard, FIG. 4 shows a partial cross-sectional view of die and cooler assembly B and a portion of a continuous rod or strand C during casting thereof. Also shown is the area of interface between the die and cooler assembly with crucible or reservoir 22. More particularly, the casting die is comprised of a somewhat tubular shell-ike arrangement generally designated 50. This shell-like arrangement may be constructed from any number of different materials commonly associated with such dies. In the preferred arrangement, the internal surface 52 defines a cylindrical die cavity between the die entrance end or area generally designated 54 and the opposite exit end or area generally designated 56. It will be appreciated that the internal surface could take other cross-sectional configurations and is dependent upon the outer wall configuration desired for the rod or strand itself.

Outer wall 58 of shell 50 has a generally cylindrical configuration over the upper end thereof which includes a plurality of liquid metal feed or intake openings and a radially outward extending flange 28. In the die construction shown, and as will be described in detail, these feed or intake openings take the place of openings 26 included for the general construction of the casting apparatus depicted in FIG. 1. As will be seen in FIG. 4, the die upper end is closely received through opening 60 in bottom wall 24 of the crucible with flange 28 then closely engaging the outside of the crucible bottom wall. The die outer wall portion 62 has a tapered configuration tapering inwardly from adjacent flange 28 toward exit end 56 and is adapted to be closely received against a tapered inner wall 64 of a cooler 66.

Cooler 66 may comprise any type of conventional cooling manifold for purposes of cooling the die and strand during a continuous casting operation and does not, in and of itself, form any part of the present invention. Accordingly, further description thereof is deemed unnecessary except to the extent that coolant is typically circulated through the manifold with the coolant inlet being spaced toward die exit and 56 and the coolant outlet being spaced adjacent the upper end.

With continued reference to FIG. 4 as well as reference to FIG. 5, a lid or plug member generally designated 70 acts as a cover for the open upper end of shell 50 adjacent area 54 for preventing ingress of liquid alloy into the shell at that area. Plug 70 includes a first cylindrical portion 72 closely received within the shell top end area and a second slightly larger portion 74 which defines a radial flange disposed in engagement with the shell upper end face.

To accommodate delivery of liquid alloy material from crucible or reservoir 22 into the die, the plurality of equidistantly spaced apart feed openings advantageously penetrate the side wall of shell 50. As shown in the FIGURES, four such feed openings 80,82,84 and 86 are provided. However, a greater or lesser amount of such openings may be advantageously utilized or desired for continuous casting of certain rod sizes and/or materials. As will be seen from FIG. 4, the feed openings incline inwardly through the shell side wall from outer surface 58 toward inner surface 52. While a number of different incline angles could be suitably employed, 45° angles are preferred.

Referring to FIG. 5, it will be noted that feed openings 80,82,84 and 86 are disposed about shell 50 in an offset type of relationship. This feature acts to provide desirable liquid metal alloy entry into the die cavity in a manner to be described hereinafter. With regard to the spacing of these feed openings, FIG. 5 shows a pair of diametral planes p,p′ which are normal to each other and extend longitudinally of shell 50. Plane p is disposed parallel to the centerlines of feed openings 80,84 and plane p′ is disposed parallel to the centerlines of feed openings 82,86. In order to achieve the best overall operational results, the lateral distances or spacings a,b of the centerlines for feed openings 80,84 in opposite directions from diametral plane p and lateral distances c,d of the centerlines for feed openings 82,86 in opposite directions of diametral plane p′ are calculated to have a preferred value. More particularly, these lateral distances are determined by and approximately equal to one half of the sum of the transverse cross-sectional area of the die chamber as defined by interior wall 52 and the transverse cross-sectional area of the associated one of feed openings 80,82,84 and 86. Also, particularly desirable results are obtained when the total of the transverse cross-sectional areas of the feed openings is approximately equal to 1/40 of the cross-sectional area of the rod being cast.

Again, it will be appreciated that while four feed openings have been shown in FIG. 5, a greater or lesser number of these openings may be desirable and/or necessary to accommodate particular casting circumstances and/or rod sizes. The diameters and positioning of such alternative feed opening arrangements will desirably vary in accordance with the above described preferred relationships as a function of the number of feed openings involved and the cross-sections of the die and resultant cast rods.

In a continuous casting operation utilized the above described die construction in conjunction with the general type continuous casting apparatus which was described with reference to FIG. 1, the ends of feed openings 80,82,84 and 86 terminating at shell outer surface 58 are disposed in communication with crucible 22. Thus, molten or liquidus copper metal alloy material flows from the crucible or reservoir into the interior of the die through the plural feed openings as designated by the arrows of FIG. 4.

Because of the relative relationships between these feed openings and the die cavity as shown in FIG. 5, a cyclonic action or motion is imparted to the liquid metal alloy as it enters the die cavity. This cyclonic action or motion is generally designated by arrows x. The cyclonic action causes generally uniform temperatures to be generated in the liquid alloy material as it proceeds downwardly through the die to the so-called near freezing zone. This near freezing zone is spaced below the feed openings themselves and is generally designated 90 in FIG. 4. In addition, the cyloncic action shears the primary dendrites disposed adjacent or near the die interior wall 52 and distributes them across the interface zone generally designated 92. Such distribution advantageously provides nuclei for equiaxed crystal growth at random locations in the interface zone.

Interface or transition zone 92 is immediately adjacent near freezing zone 90 and comprises that area at which the liquid alloy or semi-liquid alloy transforms into the solid state to thus define rod or strand C. The intermittent movement of pinch rolls (not shown) in pulling the strands outwardly from die exit end 56 allows this transformation to be substantially completed at an appropriate area within the die itself. Typically, each intermittent movement or stroke of the pinch rolls may move the strand somewhere in the range of approximately ½" to 1" at 30" per minute at various time intervals between the strokes.

During transformation from a liquid to a solid state, the above described cyclonic action or motion of the liquid alloy toward and at near freezing zone 90 effects even heat distribution in the alloy material during the transition to a solid state. The even heat distribution, in turn, prevents or eliminates formation of thermal gradients of a sufficient magnitude to produce gross directional solidification of the alloy. As described hereinabove, such gross directional solidification results in the unacceptable type of macrostructure shown in FIG. 2.

As rod or strand C is moved axially through the casting die from interface or transition zone 92, there will be some shrinkage of the rod in its transformation to the final solid state. Thus, FIG. 4 shows the outside wall 94 of the rod as being slightly spaced radially inward from die internal wall 52 as the liquid or molten copper alloy had solidified and begun to cool. Cooling of the strand is facilitated by cooler 66. As previously noted, this cooler may comprise any number of types of cooling arrangements and typically provides for the passing of cooling fluid or water therethrough in a direction generally opposite to the movement of rod or strand C.

It has been found that in using the subject invention in accordance with the above described preferred embodiment, a polygonal type grain structure having fine grain boundaries such as is schematically shown in FIG. 3 is readily obtained. Moreover, the grain size thus achieved is quite small compared to previously known and used continuous casting techniques. These results are extremely beneficial for continuous cast copper alloy rods in that they facilitate subsequent cold drawing or working of the rods without causing cracks or other imperfections therein.

By way of specific example, one type of copper alloy which has been successfully cast in accordance with the invention so as to have a fine grain structure is comprised, in weight percent, of 87.8% copper, 4% tin, 4% lead, 4% zinc and 0.2% phosphorous. Rods comprised of this material and having 3¾" diameters were cast by using both the prior art and subject casting methods. The results of these tests are set forth below in TABLE I.

TABLE I

| Grain Size | Prior Method | Subject Method |
|---|---|---|
| (a) in direction of casting | 0.5"–2.0" | 0.031"–0.063" |
| (b) normal to direction of casting | 0.063"–0.250" | 0.031"–0.063" |
| (c) cold draw results | surface cracks appeared randomly | no cracks, no scrap |

It is also considered possible to employ other means for mixing or stirring the liquid alloy material as it enters the casting die for purposes of obtaining uniform temperatures essentially throughout near freezing zone 90 for reducing or eliminating thermal gradients of a magnitude which might cause undesired gross directional solidification of the alloy. For example, electromagnetic stirring could be utilized by means of an induction type coil surrounding shell 50 at the area of near freezing zone 90. Another possible alternative is the use of mechanical stirring within the die so as to create a turbulence at near freezing zone 90. Use of such alternative means are deemed to come within the scope and intent of the present invention.

FIG. 6 shows an alternative, passive type arrangement which permits obtaining uniform temperatures in the liquid alloy material at the near freezing zone within the casting die. For ease of illustration and appreciation of this alternative, like components are identified by like numerals with a primed (') suffix and new components are identified by new numerals.

The FIG. 6 embodiment employs a heat distributor insert D constructed from a material having good heat conductive characteristics and is comprised of a distributor or dispersing portion 100, a first radial flange 102 and a second radial flange 104. Distributor portion 100 has a cylindrical configuration of a diameter less than the inside diameter of shell 50' at entrance area 54'. This dimensional relationship allows liquidus copper alloy material to flow from the crucible or reservoir into the die cavity through a plurality of transverse feed or intake openings 106 in a heat transfer relationship with distributor portion 100. Intake or feed openings 106 extend generally radially of shell 50'. The outside wall of portion 100 and the inside wall of shell 50' thus define a generally annular passageway with the flow of liquid metal into the die through intake openings 106 being generally shown by the arrows in FIG. 6.

While distributor portion 100 has a cylindrical configuration similar to that of shell 50' in the preferred embodiment, other configurations could also be advantageously employed commensurate with any changes incorporated into the configuration of shell inner wall 52'. The distributor portion also includes an inner end face 108 located axially of the shell from intake openings 106 toward die exit end 56'. This end face is spaced closely adjacent near freezing zone 90' and is disposed generally normal to the die cavity longitudinal axis.

First radial flange 102 is provided adjacent distributor portion 100 and dimensioned to be closely received in shell 50' in the manner shown. Second radial flange 104 is slightly larger than flange 102 and is adapted to rest against the uppermost end face of shell 50' as also shown. Convenient means such as retaining pins or the like (not shown) may be provided to pass transversely through shell 50' and into flange 102 for retaining distributor insert D in a positive position within the die. Also, flange 102 is axially dimensioned so that it will not extend beyond or otherwise interfere with intake openings 106 when insert D is positioned in the die.

In a continuous casting operation utilized the distributing insert in conjunction with the general type of continuous casting apparatus which has been described above, molten or liquidus alloy material flows from the crucible or reservoir into the die through intake or feed openings 106. Heat from the alloy is transferred to distributor portion 100 so that the distributor portion is at a generally constant, substantially elevated temperature throughout the entirety thereof. This heat transfer relationship is enhanced by the fact that the liquid alloy is in direct flow communication or engagement with the cylindrical side wall of distributor portion 100 as the alloy flows into the die cavity.

As the alloy flows past the distibutor portion as well as inner end face 108 thereof, it enters near freezing zone 90' at a generally uniform temperature throughout. This result is due to the passive heat sink type action of the distributor portion. Because of this generally uniform alloy temperature at near freezing zone 90', thermal gradients of a type sufficient to cause gross directional solidification of the alloy in interface or transition zone 92' are eliminated. The benefits and advantages obtained from the arrangement described with reference to FIG. 6, i.e., a polygonal grain structure with fine grain boundaries, are substantially similar to those hereinabove described with reference to the preferred arrangement and, therefore, are not reiterated here.

In addition to the specific structure arrangement of die 50' and distributor insert D shown in FIG. 6, it is also possible to utilize the concepts of the subject invention in conjunction with other configurations. For example, it is possible to eliminate use of inlet openings 106 in shell 50' and incorporate a plurality of similar openings directly into the distributor insert. In that case, the openings would be spaced apart from each other around the insert to extend axially or longitudinally thereof through flanges 102,104 at a position radially outward of distributor portion 100. Thus, liquidus or molten metal would flow through insert D from the crucible or reservoir into the die and still engage distributor 100 in a heat transfer relationship. Still other inlet openings or arrangements could be employed in practicing the overall concepts of this embodiment.

The benefits of the subject invention as described hereinabove are not limited to cold drawing of stock. In rolling for example, large grains cause wrinkled surfaces in areas where the casting is not supported by the rolls. Fine grain billets obtained by using the general concepts of the invention eliminate this problem. Further, in cast leaded bronze alloys, the subject fine grain process will provide lead dispersions which are impossible to obtain or achieve when using currently available techniques and apparatus.

The invention has been described with reference to preferred and alternative embodiments. Obviously, modifications and alterations will occur to others upon the reading and understanding of the specification. It is intended to include all such modifications and alterations insofar as they come within the scope of the appended claims or the equivalents thereof.

Having thus described the invention, it is now claimed:

1. A method for continuous casting of an alloy rod for obtaining a polygonal grain structure with fine grain boundaries, said method comprising the steps of:

providing a reservoir of alloy material in its liquid state and a hollow continuous casting die disposed in flow communication with said reservoir;

maintaining said alloy material at a temperature above its liquid temperature at least adjacent the area of flow communication between said reservoir and die;

delivering said liquid alloy material from said reservoir to said die through flow passages which are completely submerged in said reservoir of liquid alloy material;

transforming said liquid alloy material to a solid state in said die at an interface zone extending across the cross-sectional area of said alloy as said liquid alloy material moves through said die to said interface zone from a near freezing zone adjacent said interface zone;

said step of transforming said liquid alloy material to a solid state being carried out to obtain a general fine polygonal grain structure throughout substantially the entire cross-sectional area of said alloy at said interface zone by eliminating gross directional solidification of said alloy material at said interface zone;

said step of transforming said liquid alloy material to a solid state with a generally polygonal grain structure being carried out by maintaining the temperature of said liquid alloy material generally uniform throughout the cross-sectional area thereof at least adjacent said near freezing zone; and, said step of maintaining the temperature of said liquid alloy material generally uniform including the step of producing transverse movement of said liquid alloy material throughout substantially the entire cross-sectional area thereof adjacent said near freezing zone in a direction transverse to the direction of movement of said alloy material through said die, said step of producing transverse movement of said liquid alloy material being carried out by focusing entry of said liquid alloy material into said die through said passages so as to impart a generally cyclonic motion thereto during said step of delivering.

2. The method as defined in claim 1 wherein said step of focusing entry of said liquid alloy material into said die is carried out by arranging said flow passages as a plurality of spaced apart liquid alloy material feed openings arcuately spaced apart from each other around said die and in flow communication between said reservoir and said die and with said feed openings entering said die adjacent said near freezing zone.

3. The method as defined in claim 2 further including the step of positioning said feed openings so as to extend downwardly through said die side wall from the area of communication with said reservoir toward the area of communication with the interior of said die.

4. In apparatus for continuous casting of an elongated rod wherein liquid alloy material flows from a reservoir into a hollow die through flow passages which are completely submerged in said liquid alloy material in said reservoir for transformation into a solid state at an interface zone to form a portion of said rod having the cross sectional conformation of said die and wherein rod portions thus formed are continuously drawn outwardly from a die exit end, an improved arrangement for obtaining a polygonal grain structure and fine grain boundaries in said rod comprising:

heat controlling means disposed in operative communication with said die to facilitate generally uniform temperatures in said liquid alloy material at a near freezing zone therefor adjacent said interface zone, said heat controlling means preventing the formation of thermal gradients in said alloy material for a sufficient magnitude to produce gross directional solidification thereof at said interface zone; and, said heat controlling means including means for continuously mixing said alloy material in said die at least adjacent said near freezing zone as said alloy material flow toward said interface zone by producing transverse movement of said liquid alloy material throughout substantially the entire cross-sectional area thereof at least adjacent said near freezing zone, wherein said means for mixing includes a plurality of alloy feed passages defined by feed openings communicating between said reservoir and the interior of said die adjacent said near freezing zone, said feed openings being spaced apart from each other and focused into said die interior in a manner for automatically imparting a generally cyclonic motion to said liquid alloy material as it enters said die, said cyclonic motion also causing shearing of primary dendrites in said alloy from adjacent the internal side wall of said die and distributing said dendrites across said interface zone to provide nuclei for equiaxed crystals.

5. The improvement as defined in claim 4 wherein the total transverse cross-sectional area of said feed openings is approximately 1/40 of the transverse cross-sectional area of the die cavity.

6. The improvement as defined in claim 4 wherein said plurality of feed openings are arcuately spaced apart from each other around said die.

7. The improvement as defined in claim 6 wherein said feed openings incline downwardly through the side wall of said die from the area of communication with said reservoir to the area of communication with said die interior.

* * * * *